US007021126B1

(12) United States Patent
Badami et al.

(10) Patent No.: US 7,021,126 B1
(45) Date of Patent: Apr. 4, 2006

(54) METHODS FOR LOW-COST ESTIMATION OF STEAM TURBINE PERFORMANCE

(75) Inventors: Vivek Venugopal Badami, Schenectady, NY (US); Jitendra Kumar, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/941,153

(22) Filed: Sep. 15, 2004

(51) Int. Cl.
*G01M 15/00* (2006.01)

(52) U.S. Cl. ..... 73/112

(58) Field of Classification Search ..... 73/116, 73/117.2, 117.3, 117.4, 118.1, 1.27, 1.28, 73/112; 60/643, 646; 702/105, 108, 113, 702/182, 183
See application file for complete search history.

(56) References Cited

U.S. PATENT DOCUMENTS 4,866,940 A * 9/1989 Hwang et al. ..... 60/646
4,891,948 A 1/1990 Kure-Jensen et al.
5,261,437 A 11/1993 Kalix
5,327,772 A 7/1994 Fredricks
5,367,470 A * 11/1994 Lang ..... 700/274
5,621,654 A 4/1997 Cohen et al.
5,832,421 A 11/1998 Santoso et al.
5,838,588 A 11/1998 Santoso et al.
6,098,009 A 8/2000 Wettstein
6,910,364 B1 * 6/2005 Girbig ..... 73/1.27
6,912,889 B1 * 7/2005 Staphanos et al. ..... 73/23.31
2004/0010387 A1 * 1/2004 Girbig ..... 702/113
2005/0177340 A1 * 8/2005 Draxton et al. ..... 702/182

* cited by examiner

*Primary Examiner*—Eric S. McCall
(74) *Attorney, Agent, or Firm*—Armstrong Teasdale LLP

(57) ABSTRACT

A method for determining efficiency of an installed steam turbine includes estimating, at a first plurality of times, a first mean value and a first variance of at least one performance variable of the steam turbine utilizing a set of station sensors. The method further includes estimating, at a second plurality of times including times encompassing at least some of the first plurality of times, a second mean value and a second variance of the at least one performance variable utilizing a different set of sensors, wherein the different set of sensors includes precision sensors. A mapping function is determined between the first mean values and the second mean values using the first mean values, the first variances, the second mean values, and the second variances.

24 Claims, 4 Drawing Sheets

METHODS FOR LOW-COST ESTIMATION OF STEAM TURBINE PERFORMANCE

BACKGROUND OF THE INVENTION

This invention relates generally to steam turbine generator systems, and more particularly to methods for estimating performance of steam turbines using relatively inexpensive sensors.

Large steam turbine-generator systems represent major capital investments for their owners and their economic benefit to their owners varies with the thermal efficiency with which the steam turbines are operated. Owners of large steam turbine generators are vitally interested in maintaining the operating parameters of the system as close as possible to the optimum set of operating parameters as designed for the system and/or developed during operational testing following initial installation of the system. In addition, degradation in performance over time can occur due to deterioration of internal parts and other causes.

As part of the installation procedure of a steam turbine-generator subsystem, it is customary for the owners and/or the contractor or turbine manufacturer to conduct very accurate tests with a variety of special purpose, precision sensors to demonstrate or determine the heat rate of the system. Heat rate is a measure of thermal efficiency of a steam turbine-generator system defined as the number of units of thermal input per unit of electrical power output. One standard test of heat rate is known as the ASME test and is defined in an ASME publication ANSI/ASME PTC6—1976 Steam Turbines. A requirement and characteristic of both of the above tests is accurate instrumentation for temperatures, pressures and flows within a steam turbine along with the resulting generator power output to determine accurately the energy content of such conditions and the resulting power output. The accuracy of measurement is sufficiently great that relatively small measurement tolerances need be applied to the results. Such tests are costly to perform. For example, the standard ASME test requires a substantial installation of specialized measuring equipment at a substantial cost in conjunction with a great amount of manpower to administer the test. Besides their cost, ASME-type tests have the additional drawback that they are not suitable for use in day-to-day operation of a steam turbine-generator system.

Because it is expensive to repeat the tests at additional times throughout the lifetime of the turbine, in at least one known method of performance testing of steam turbines, the turbines are provided with a number of "station" sensors to estimate performance.

For example, U.S. Pat. No. 4,891,948 issued Jan. 9, 1990 to Kure-Jensen et al. describes a thermal performance monitor that informs the operator and results engineer of the economic losses, efficiencies, deviations in heat rates and power losses of operating a steam turbine-generator system at its controllably selected pressure and temperature. Specific temperature and pressure signals are generated at various points in the system along with the control valve position signal and the electrical output signal from the electric generator. This data is processed along with the corresponding design values and the economic losses due to temperature deviation, pressure deviation and exhaust pressure deviation from design are calculated. Other calculations produce a comparison of efficiencies of the turbines in the system and consequential power losses.

U.S. Pat. No. 5,327,772 issued Jul. 12, 1994 to Fredricks describes a method and apparatus for determining steam quality wherein heat is added to or removed from a sample flow of steam to reach a point of superheating or supercooling. The amount of energy required to superheat or subcool the sample is factored in with other parameters such as steam flow rate, temperature and pressure to determine the quality of the steam. The steam quality sensor is said to have application in equipment such as turbines, etc.

U.S. Pat. No. 5,621,654 issued Apr. 15, 1997 to Cohen et al. relates to methods and systems for economically dispatching electrical power. Real-time heat rates for a plurality of power generating units, for example, steam turbines, and corresponding emission data for each unit are used to dispatch electrical power at a reduced cost. The method described therein also compares the cost associated with generating power to the cost to purchase power from other electric utilities to achieve savings associated with the dispatching of the electrical power. Each power generating unit includes sensors that are connected to the boiler, steam turbine, and generator. The sensors are known in the art and are provided to measure, for example, water and air temperature and pressure, fuel flow, electrical power, and like characteristics of the power generation portion of the power generating unit. Data generated by each sensor is transferred to a data acquisition interface to be utilized by a plant processor to calculate real time heat rate and to generate a heat rate curve used by the system operator economically dispatch electrical power.

U.S. Pat. No. 5,832,421 issued Nov. 3, 1998 pertains to a method for blade temp estimation in a steam turbine. The method utilizes measurement values including pressure and temperature at locations other than directly at the blades, principally at the input and output stages. Initially, blade temperature is simulated by using a water/steam cycle analysis program as well as by directed experiments. It is also disclosed that in some large steam turbines, temperature measuring devices are installed at respective stages of the HP and LP casings. These measurements provide an indication to the operator or supervising engineer in charge whenever the blade temperature exceeds its limit.

Although station sensors provide useful estimates of performance, station sensors are substantially less accurate than their precision counterparts. Therefore, performance estimates produced using data from station sensors is also less accurate than performance estimates produced using precision sensors.

BRIEF DESCRIPTION OF THE INVENTION

There is therefore provided, in some configurations of the present invention, a method for determining efficiency of an installed steam turbine. The method includes estimating, at a first plurality of times, a first mean value and a first variance of at least one performance variable of the steam turbine utilizing a set of station sensors. The method further includes estimating, at a second plurality of times including times encompassing at least some of the first plurality of times, a second mean value and a second variance of the at least one performance variable utilizing a different set of sensors, wherein the different set of sensors includes precision sensors. A mapping function is determined between the first mean values and the second mean values using the first mean values, the first variances, the second mean values, and the second variances.

In yet other aspects, the present invention provides a processor for determining efficiency of a steam turbine. The processor is configured to estimate, at a first plurality of times, a first mean value and a first variance of at least one performance variable of the steam turbine utilizing a set of station sensors. The processor is also configured to estimate, at a second plurality of times including times encompassing at least some of the first plurality of times, a second mean value and a second variance of a performance variable utilizing a different set of sensors, wherein the different set of sensors includes precision sensors. The processor is also configured to determine a mapping function between the first mean values and the second mean values using the first mean values, the first variances, the second mean values, and the second variances.

In yet another aspect, the present invention provides a machine-readable medium having instructions recorded thereon configured to instruct a processor to estimate, at a first plurality of times, a first mean value and a first variance of at least one performance variable of a steam turbine utilizing a set of station sensors. The instructions also are configured to instruct the processor to estimate, at a second plurality of times including times encompassing at least some of the first plurality of times, a second mean value and a second variance of the performance variable utilizing a different set of sensors, wherein the different set of sensors includes precision sensors. The instructions are further configured to determine a mapping function between the first mean values and the second mean values using the first mean values, the first variances, the second mean values, and the second variances.

If it is established that the mapping is approximately constant over time and repeatable across several steam turbines of the same code type with a high degree of confidence, then for another steam turbine of the same code type equipped with only station sensors, the predetermined mean shift can be applied to obtain increased performance estimate accuracy from the station sensors. The variance will be higher than that obtained with the precision sensors, but will still be serviceable. The increased performance estimate accuracy is thus obtained at a low future cost, as precision sensors are no longer needed after an appropriate mapping is determined, until it is known that a re-calibration, replacement, or other change of sensors that could affect an efficiency estimate of interest has been made. At that time, another registration of station sensor based efficiency determination with a precision sensor-based calculation can be performed.

DETAILED DESCRIPTION OF THE INVENTION

The principal controls available to a shift operator of a steam turbine-generator system include boiler controls which determine the temperature and pressure of the main steam and reheat steam supplies and a main steam admission control valve or valves which determines the amount of steam admitted to the first or high pressure turbine stage. Practical guidance to an operator of such a steam turbine-generator system includes evaluations of the substantially instantaneous operating parameters in a manner that can be interpreted easily, quickly and without detailed technical analysis to facilitate the manipulation of these principal controls. A technical effect of the present invention is the providing of serviceable performance estimates using station sensors in place of precision sensors.

Figure 1:
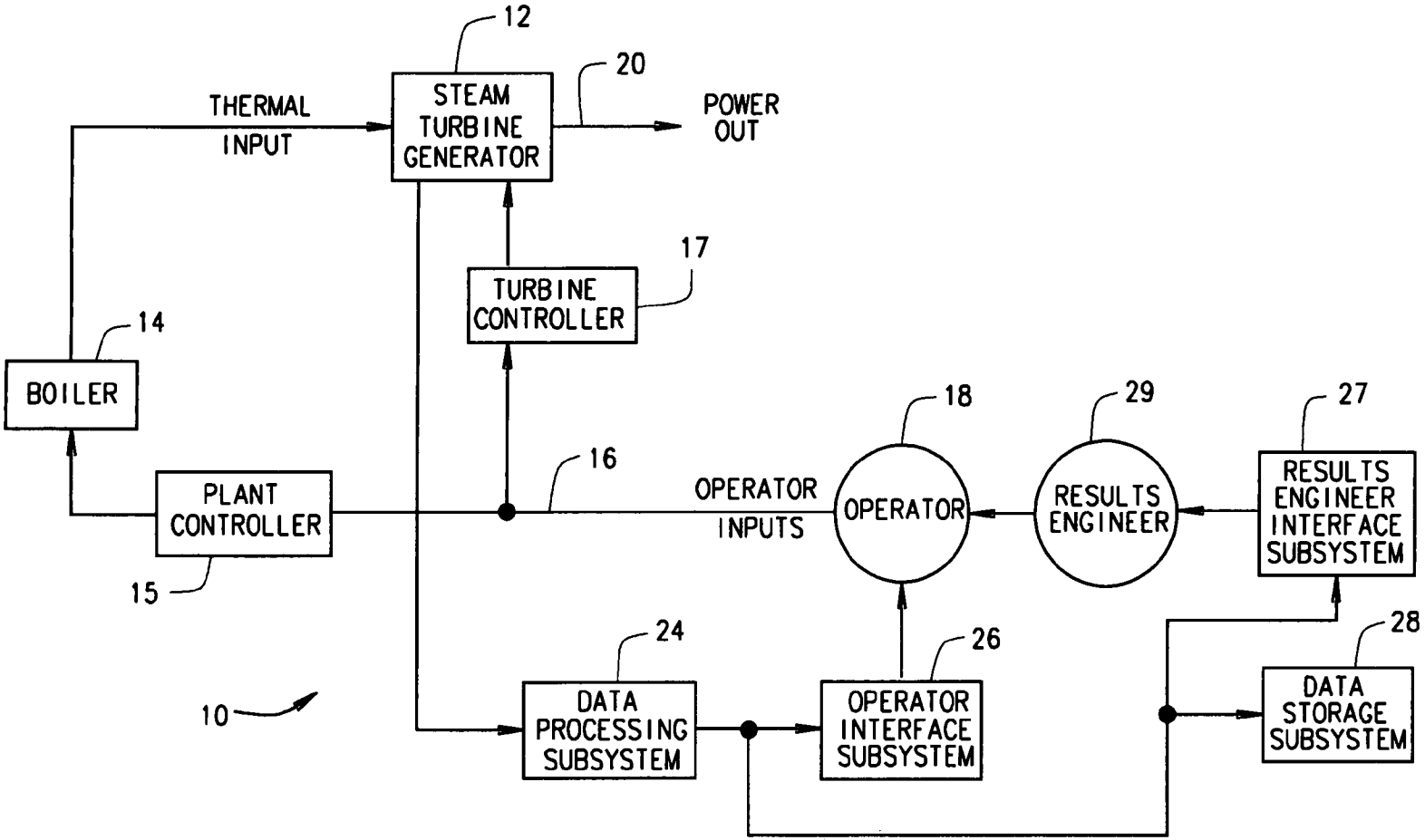
FIG. 1 is a simplified block diagram of a steam turbine-generator system.

Referring now to FIG. 1, there is shown generally, a steam turbine-generator system 10. Steam turbine-generator system 10 includes a steam turbine-generator 12 receiving a thermal input from a steam boiler 14. Boiler 14 may be of any convenient type, such as a coal-fired, oil-fired, or heat recovery steam generator. Steam turbine-generator 12 is controlled by a turbine controller 17 and boiler 14 is controlled by a plant and real-time controller 15, with operator inputs represented by a line 16 from an operator 18. Electric power output is produced and represented by a line 20. A set of measured parameters from steam turbine-generator 12 are applied on a line 22 to a data processing subsystem 24. The types of measured parameters are those which can be obtained with sufficient reliability and accuracy over the long term and which can be interpreted by data processing subsystem 24 in a fashion which can guide operator 18 in controlling steam turbine-generator 12 and boiler 14 on a minute-by-minute basis. The outputs of data processing subsystem 24 are applied to an operator interface subsystem 26 which may be of a conventional type such as, for example, a cathode ray tube display, a printer or other types of analog or digital display devices. The output from data processing subsystem 24, may also be applied to a data storage subsystem 28 wherein the data may be stored for short-term or long-term purposes. Data storage subsystem 28 may be of any convenient type including a printer. However, in an embodiment used as an example herein, data processing subsystem 24 includes a digital processor and data storage subsystem 28 preferably includes a digital storage device such as, for example a magnetic or optical disc or a magnetic tape storage device.

Coupled in parallel with operator interface subsystem 26 is a results engineer interface subsystem 27. Interface 27 allow a results engineer 29 to study the outputs of data processing subsystem 24 on a more leisurely basis as compared with operator 18. Results engineer 29 communicates with operator 18 to improve the long-term performance of turbine-generator system 10 due in part to the higher level, sophisticated analysis with which the engineer views the data. The engineer also determines the maintenance procedures for the system and subsystem 27 assists in the promulgation of those procedures.

Figure 2:
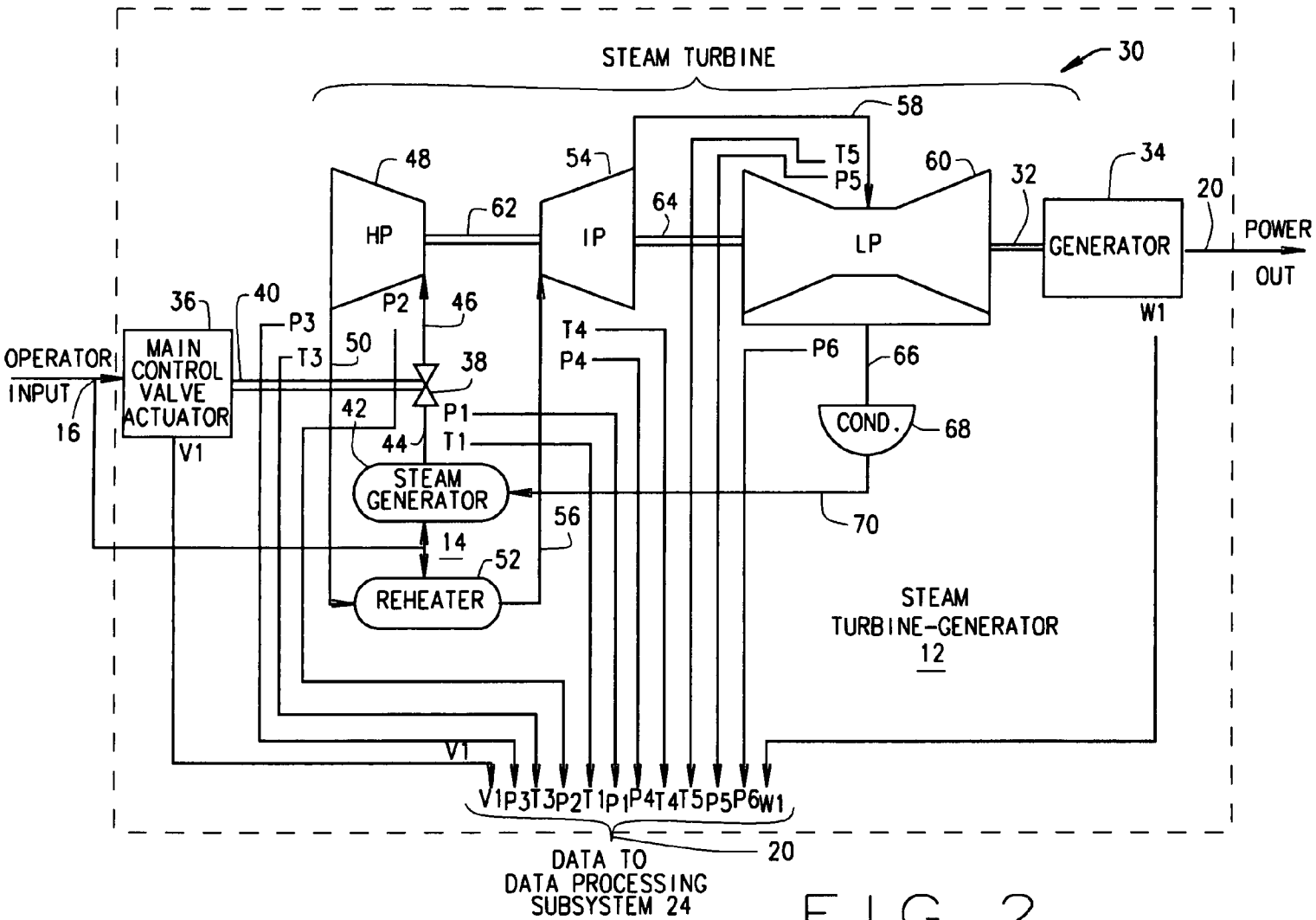
FIG. 2 is a simplified schematic diagram of a steam turbine-generator showing monitoring points employed in configurations of the present invention.

Referring now to FIG. 2, a simplified schematic diagram of steam turbine-generator 12 is shown including only that detail necessary to describe the present invention. Steam turbine-generator 12 is conventional and has measurement devices installed therein. Thus, a detailed description of steam turbine-generator 12 is omitted. The present invention uses temperature and pressure measurements at various locations throughout steam turbine-generator system 10, including a measurement of the generated electrical power output, and compares their relationship to corresponding design values to determine the power losses, efficiencies and heat rates throughout the system.

Steam turbine-generator 12 of FIG. 1 includes a steam turbine 30 coupled through a mechanical connection 32, to an electric generator 34 which generates an electric power output. A transducer (not shown) in electric generator 34 produces an electric power output signal W1 which is applied to line 22 for transmission to data processing subsystem 24. The operator input on line 16 is applied by hydraulic, electrohydraulic, digital or other well known means, to a main control valve actuator 36 which affects a main control steam admission valve 38 as illustrated by line 40. A valve position signal V1, is generated by appropriate means and represents the amount by which main control valve 38 is opened, and the signal is applied to line 22 for transmission to data processing subsystem 24. It is to be understood that valve 38 is representative of a number of steam admission control valves commonly associated with a steam turbine.

A steam generator 42, which is part of boiler 14, produces a supply of hot pressurized steam that is applied to main control valve 38 on a line 44. The steam passing through main control valve 38 is applied on a main steam line 46 to an input of a high pressure turbine 48. As utilized herein, the term "HP" refers to high pressure turbine 48. Steam exiting from HP turbine 48, now partially expanded and cooled, but still containing substantial energy, is applied on a cold reheater line 50 to a reheater 52 which is also part of boiler 14. The pressure and temperature of the steam in line 44, upstream of main control valve 38 and generally at its inlet are measured by sensors (not shown) to produce a representative first pressure signal P1 and a first temperature signal T1 which are transmitted to data processing subsystem 24. The pressure and temperature of the steam in cold reheater line 50, downstream of high pressure turbine 48 at substantially its exit, are measured by sensors (not shown) to produce a representative third pressure signal P3 and a third temperature signal T3 which are also transmitted to data processing subsystem 24.

A pressure sensor (not shown) produces a pressure signal P2, representing the pressure sensed proximate the first stage of HP turbine 48, and the signal is transmitted to data processing subsystem 24.

An intermediate pressure turbine 54 (hereinafter "IP" turbine) receives reheated steam from reheater 52 on a hot reheater line 56, expands the steam to extract energy from it and exhausts the steam through an exhaust line 58 to a low pressure turbine 60. Mechanical outputs of HP turbine 48, IP turbine 54 and low pressure turbine 60 (hereinafter "LP" turbine) are interconnected mechanically as shown by coupling means 62 and 64 which are, in turn, mechanically coupled to connection 32 and to the generator 34. A fourth temperature T4 and pressure P4 in hot reheater line 56, upstream of IP turbine 54 are measured by sensors (not shown) and representative signals are transmitted to data processing subsystem 24. In addition, a fifth temperature T5 and pressure P5 of the steam in line 58, downstream of IP turbine 54, is measured by sensors (not shown) and signals representing those quantities are also transmitted to data processing subsystem 24. In another embodiment, T5 and P5 are measured at the low pressure bowl of LP turbine 60.

Exhaust steam from LP turbine 60 is applied on a line 66 to a condenser 68 wherein the steam is condensed to water and thereafter conveyed on a line 70 to steam generator 42 for reuse. One of the factors that can degrade system efficiency is deficient operation of condenser 68 which can result in higher than normal back pressure at the exhaust of low pressure turbine 60. Such back pressure is an indication that the operation of condenser 68 requires adjustment for improved efficiency. A pressure sensor (not shown) in line 66 produces an exhaust pressure signal P6 which is transmitted to data processing subsystem 24 for further processing and display.

It should be noted that the temperature sensors used may be of any convenient type, however, in an embodiment described herein, each temperature sensor includes a plurality of high accuracy chromel constantan (Type E) thermocouples disposed in a well and positioned to give access to the steam whose temperature is to be measured. By using a plurality of thermocouples for each sensor, the results from the plurality of thermocouples may be averaged to substantially reduce individual thermocouple errors or minor differences in system temperatures. In addition, the availability of more than one thermocouple offers a measure of redundancy in case of failure of one or more of the thermocouples at a sensor location. Transmission of the temperature signals may be accomplished using analog voltages or the temperature signals may be digitized before transmission to make the measurements less susceptible to the lengths of cable runs and to noise. Similarly, the pressure sensors may be of any convenient type such as, for example, pressure sensors commercially available under the name Heise Model 715T or Rosemont pressure transmitter having appropriate pressure, accuracy and environmental temperature ranges.

Various methods for determining efficiencies utilizing sensors of the types described herein are detailed in U.S. Pat. No. 4,891,948 to Kure-Jensen et al., and need not be described in detail herein. In addition, test procedures for precision estimates of steam turbine efficiency (including ASME PTC 6.0) are well-known from various ANSI (American National Standards Institute) and ASME publications, and need not be repeated in detail here.

Figure 3:
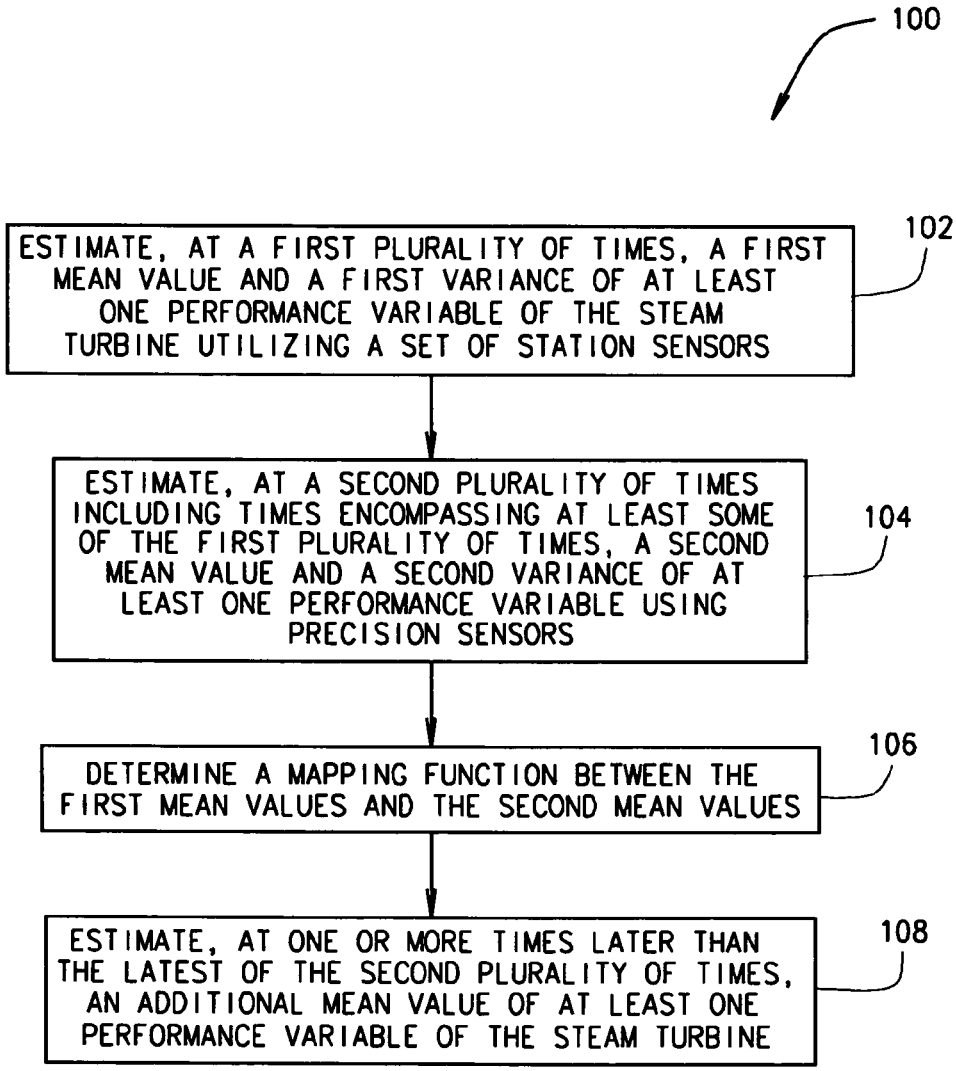
FIG. 3 is a flow chart representative of various configurations of a method for low-cost estimation of steam turbine performance of the present invention.

In some configurations of the present invention and referring to FIG. 3, a method 100 for determining efficiency of an installed steam turbine is provided. This method can be performed, for example, by an operator initiating a sequence of pre-programmed instructions corresponding to the steps of method 100 that reside in a memory of data processing subsystem 24. However, another data processing subsystem or suitable processing system, such as a computer workstation, may be used in other configurations. In some configurations, the sequence of pre-programmed instructions is supplied as recorded instructions that instruct a processor to perform the steps of the method. These instructions may be recorded on a machine-readable medium such as a floppy disk, a CD-ROM, a CD-R or CD-RW, or a DVD. (It is intended that the term "machine-readable medium" be construed broadly so as to include configurations in which parts of a complete set of instructions are divided between multiple similar and/or different types of media.) A technical effect of the present invention is achieved by estimating, at a first plurality of times, a first mean value and a first variance of at least one performance variable of the steam turbine utilizing a set of station sensors at 102. These station sensors include, in some configurations, a plurality of sensors (not shown in FIG. 1 and FIG. 2) that may include those that produce temperature and pressure signals T1, T2, T3, T4, T5, P1, P2, P3, P4, and P5 and electrical power output signal W1. The method further includes estimating, at a second plurality of times including times encompassing at least some of the first plurality of times, a second mean value and a second variance of the at least one performance variable at 104. The estimate at 104 utilizes a difference set of sensors, including precision sensors (also not shown in the Figures.) The method further includes determining a mapping function between the first mean values and the second mean values at 106. This mapping uses the first mean values, the first variances, the second mean values, and the second variances.

As used herein, "first mean values" refers to a set of mean value estimates, each representing a performance variable at a different time. The first mean values are determined utilizing a set of station sensors. Similarly, "first variances" refers to a corresponding set of variance estimates. "Second mean values" refers to a set of mean value estimates, each representing a performance variable at a different time, not necessarily corresponding to the times of the first mean values, although in some configurations, the second mean values represent a set of mean value estimates close to the times of the first mean values. The second mean values are determined utilizing a set of sensors that includes precision sensors. "Second variances" refers to a corresponding set of variance estimates. The terms "first" and "second" in these terms do not necessarily refer to an ordering in time, quantity, etc., and are used only to distinguish the two sets of estimates.

Also, the term "station sensors" refers to a set of sensors associated with and included with a steam turbine installation. Station sensors may be used for continuous monitoring of the steam turbine installation. On the other hand, "precision sensors" are sensors such as those used to accurately determine ASME PTC 6.0 efficiencies. These sensors are not included in the installation, but are normally used by the manufacturer for initial performance measurements and are typically not permanently installed in the turbine.

In some configurations of the present invention, at one or more times later than the latest of the second plurality of times, an additional mean value of the at least one performance variable of the steam turbine is estimated at 108. This additional mean value estimate uses the set of station sensors and the mapping function. Each such additional mean value estimate corresponds to a performance variable estimate that is corrected for offset and other errors in measurement resulting from the use station sensors that are inherently less accurate than precision sensors. Although the variance of such estimates will be higher than those obtained using precision sensors, the mean values of such estimates will be more accurate than if the mapping had not been used, and provide useful performance estimates made using only inexpensive sensors.

In some configurations, the at least one performance variable is or includes one or more second efficiencies of HP, IP, and LP sections of the steam turbine.

Also in some configurations, at additional times, a third mean value and a third variance of the at least one performance variable is estimated. (Again, the term "third," as used herein in this context, does not refer to an ordering in time, value, importance, etc., but rather is used to distinguish one set of measurements from another set of measurements.) The third mean value and third variance values are estimated utilizing a subset sensors, which includes at least one precision sensor, but may include less than all of the precision sensors used to determine the second mean estimates and the second variance estimates. These estimates may be used to augment the second mean estimates and second variance estimates using a smaller and therefore less costly subset of precision sensors, but nevertheless more accurate (and independent of) the station sensors. In some configurations, the additional times include times between a beginning and an ending time of the second plurality of times, and the additional times are each different from times in the second plurality of times. The set of precision sensor measurements referred to here can be used as a substitute for a full PTC6.0 style performance test.

In some configurations, the methods described herein may be repeated until it is determined that the mapping function is essentially constant over time. Also in some configurations, the estimation using the set of precision sensors can include obtaining ASME PTC 6.0 estimates, although various configurations of the present invention are not dependent upon having a full suite of PTC6.0 instrumentation for the precision-sensor based efficiency estimate. A precision test using a subset of the PTC6.0 instrumentation for estimating section efficiencies is sufficient to determine the desired mapping between station sensor-based and precision sensor-based efficiency estimates.

Some configurations of the present invention also provide for repeating the steps of the method at a plurality of steam turbines at different installations to determine repeatability across sensors of the same type. In doing so, it becomes possible to provide a mapping effective for sensors of the same type without having to repeat all of the steps of the method (especially those involving precision sensors) at all steam turbine installations using that type of sensor.

Figure 4:
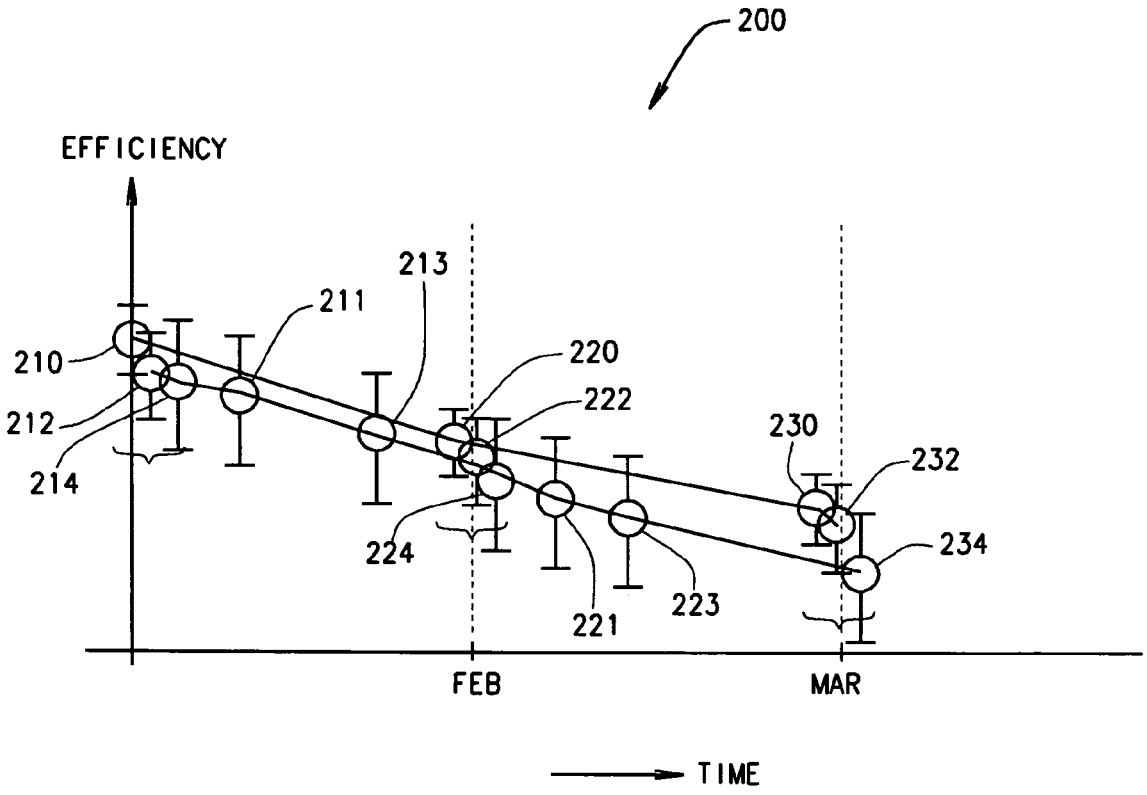
FIG. 4 is a graph illustrating some of the estimates obtained by a representative use of a configuration of the present invention.

For further illustration and referring to graph 200 of FIG. 4, let us assume that at least two or more precision estimates (ASME PTC6.0) of efficiency are available, and that that various sensor estimates at times January (estimates 210, 212, and 214), February (estimates 220, 222, and 224), and March (estimates 230, 232, and 234) are available. A plurality of measurements at each time are used to determine a mean (represented by centers of circles at measurements) and standard deviation (bars above and below each circle) for precision sensor-based performance estimates 210, 220, and 230. "Performance" as used herein refers to section efficiencies determined for the steam turbine HP, IP, and LP sections. Heat rate can also be calculated and plotted on the ordinate. In addition, performance estimates (section efficiencies) are determined (214, 224, 234) using (for example) only station sensors at the same time. At the same time, performance estimates (section efficiencies) are also determined (212, 222, and 232) using a subset of the precision sensor set, as well as using station sensors. The subset of precision sensors is also useful, but not essential, for practicing the present invention. For obtaining an intermediate data points such as 211, 213, 221, and 223, i.e., performance estimates are performed using the station set. Estimates at 211, 213, 221, and 223 are determined at a set of times between and different from the times at which estimates 210, 220, and 230 were obtained using a full set of precision sensors.

For purposes of illustration, the error band or variance associated with each of the three performance estimation methods are shown in relative proportions, with the variance for the precision sensor-based estimation being the smallest, and that with the station sensor-based estimate being the largest.

While the extra cost of precision sensor-based estimates limits their availability, there is no limit to the number of station sensor-based estimates that can be made available, inasmuch as the latter are being monitored continuously via on-site monitoring hardware interfaced to the steam turbine control system.

Once a sufficient number of points are determined, trends in performance estimates for each of the three cases can be established, and a mapping between the two sets of estimates can be determined. If it is established that the mapping is approximately constant over time and repeatable across several steam turbines of the same code type with a high degree of confidence, then for another steam turbine of the same code type equipped with only station sensors, the predetermined mean shift can be applied to obtain increased performance estimate accuracy from the station sensors. The variance will be higher than that obtained with the precision sensors, but will still be serviceable. The increased performance estimate accuracy is obtained at a low future cost, as precision sensors are no longer needed after an appropriate mapping is determined.

While the invention has been described in terms of various specific embodiments, those skilled in the art will recognize that the invention can be practiced with modification within the spirit and scope of the claims.

What is claimed is:

1. A method for determining efficiency of an installed steam turbine, said method comprising:

estimating, at a first plurality of times, a first mean value and a first variance of at least one performance variable of the steam turbine utilizing a set of station sensors;

estimating, at a second plurality of times including times encompassing at least some of said first plurality of times, a second mean value and a second variance of said at least one performance variable utilizing a different set of sensors, wherein said different set of sensors comprises precision sensors; and determining a mapping function between said first mean values and said second mean values using said first mean values, said first variances, said second mean values, and said second variances.

2. A method in accordance with claim 1, further comprising estimating, at least at one time later than the latest of said second plurality of times, an additional mean value of said at least one performance variable of the steam turbine utilizing said set of station sensors and said mapping function.

3. A method in accordance with claim 1 wherein said at least one performance variable comprises section efficiencies of HP, IP, and LP sections of the steam turbine.

4. A method in accordance with claim 1 further comprising estimating, at additional times, a third mean value and a third variance of said at least one performance variable utilizing a subset of said different set of sensors, including at least one said precision sensor, and wherein said determining a mapping function further includes using said third mean values and said third variances along with said first mean values, said first variances, said second variances, and said second variances.

5. A method in accordance with claim 4 wherein said additional times include times between a beginning and an ending time of said second plurality of times and said additional times are different from said second plurality of times.

6. A method in accordance with claim 1 further comprising determining that said mapping function is essentially constant over time.

7. A method in accordance with claim 1 wherein said estimating utilizing said different set of sensors comprises obtaining ASME PTC 6.0 estimates.

8. A method for determining efficiency of an installed steam turbine, said method comprising:

estimating, at a first plurality of times, a first mean value and a first variance of at least one performance variable of the steam turbine utilizing a set of station sensors;

estimating, at a second plurality of times including times encompassing at least some of said first plurality of times, a second mean value and a second variance of said at least one performance variable utilizing a different set of sensors, wherein said different set of sensors comprises precision sensors;

determining a mapping function between said first mean values and said second mean values using said first mean values, said first variances, said second mean values, and said second variances; and repeating said estimating steps and said determining step at a plurality of steam turbines of the same code types at different installations to determine repeatability across sensors of said same type.

9. A method in accordance with claim 8 wherein said at least one performance variable comprises section efficiencies of HP, IP, and LP sections of the steam turbine.

10. A method in accordance with claim 8 further comprising determining that said mapping function is essentially constant over time.

11. A method in accordance with claim 8 wherein said estimating utilizing said different set of sensors comprises obtaining ASME PTC 6.0 estimates.

12. A method in accordance with claim 8, further comprising estimating, at least at one time later than the latest of said second plurality of times, an additional mean value of said at least one performance variable of each said steam turbines of said plurality of steam turbines utilizing said set of station sensors and said mapping function.

13. A method in accordance with claim 8 further comprising estimating, at additional times at each said steam turbine of said plurality of steam turbines, a third mean value and a third variance of said at least one performance variable utilizing a subset of said different set of sensors, including at least one said precision sensor, and wherein said determining a mapping function further includes using said third mean values and said third variances along with said first mean values, said first variances, said second variances, and said second variances.

14. A method in accordance with claim 13 wherein said additional times include times between a beginning and an ending time of said second plurality of times and said additional times are different from said second plurality of times, for each said steam turbine of said plurality of steam turbines.

15. A processor for determining efficiency of a steam turbine, said processor configured to:

estimate, at a first plurality of times, a first mean value and a first variance of at least one performance variable of the steam turbine utilizing a set of station sensors;

estimate, at a second plurality of times including times encompassing at least some of said first plurality of times, a second mean value and a second variance of said at least one performance variable utilizing a different set of sensors, wherein said different set of sensors comprises precision sensors; and determine a mapping function between said first mean values and said second mean values using said first mean values, said first variances, said second mean values, and said second variances.

16. A processor in accordance with claim 15, further configured to estimate, at least at one time later than the latest of said second plurality of times, an additional mean value of said at least one performance variable of the steam turbine utilizing said set of station sensors and said mapping function.

17. A processor in accordance with claim 15 wherein said at least one performance variable comprises section efficiencies of HP, IP, and LP sections of the steam turbine.

18. A processor in accordance with claim 15 further configured to estimate, at additional times, a third mean value and a third variance of said at least one performance variable utilizing a subset of said different set of sensors, including at least one said precision sensor, and wherein to determine a mapping function, said processor is further configured to use said third mean values and said third variances along with said first mean values, said first variances, said second variances, and said second variances.

19. A processor in accordance with claim 18 wherein said additional times include times between a beginning and an ending time of said second plurality of times and said additional times are different from said second plurality of times.

20. A machine-readable medium having instructions recorded thereon that are configured to instruct a processor to:

estimate, at a first plurality of times, a first mean value and a first variance of at least one performance variable of a steam turbine utilizing a set of station sensors;

estimate, at a second plurality of times including times encompassing at least some of said first plurality of times, a second mean value and a second variance of said at least one performance variable utilizing a different set of sensors, wherein said different set of sensors comprises precision sensors; and determine a mapping function between said first mean values and said second mean values using said first mean values, said first variances, said second mean values, and said second variances.

21. A medium in accordance with claim 20, wherein said instructions are further configured to instruct a processor to estimate, at least at one time later than the latest of said second plurality of times, an additional mean value of said at least one performance variable of the steam turbine utilizing said set of station sensors and said mapping function.

22. A medium in accordance with claim 20 wherein said at least one performance variable comprises section efficiencies of HP, IP, and LP sections of the steam turbine.

23. A medium in accordance with claim 20 wherein said instructions are further configured to instruct a processor to estimate, at additional times, a third mean value and a third variance of said at least one performance variable utilizing a subset of said different set of sensors, including at least one said precision sensor, and wherein to determine a mapping function, said instructions are further configured to instruct a processor to use said third mean values and said third variances along with said first mean values, said first variances, said second variances, and said second variances.

24. A medium in accordance with claim 23 wherein said additional times include times between a beginning and an ending time of said second plurality of times and said additional times are different from said second plurality of times.

* * * * *